US006257033B1

(12) United States Patent
Ziv-Av

(10) Patent No.: US 6,257,033 B1
(45) Date of Patent: Jul. 10, 2001

(54) CYLINDER LOCK WITH ROTATABLE PINS

(75) Inventor: Amir Ziv-Av, Kiryat Ono (IL)

(73) Assignee: Moshe Dolev, Ramat Hasharon (IL)

( * ) Notice: Subject to any disclaimer, the term of this patent is extended or adjusted under 35 U.S.C. 154(b) by 0 days.

(21) Appl. No.: 09/263,852

(22) Filed: Mar. 8, 1999

(51) Int. Cl.[7] ..... E05B 27/06
(52) U.S. Cl. ..... 70/494; 70/409; 70/495
(58) Field of Search ..... 70/409, 493, 494, 70/495, 394, 378

(56) References Cited

U.S. PATENT DOCUMENTS

| | | | | |
|---|---|---|---|---|
| 2,021,185 | * | 11/1935 | Hurd | 70/495 |
| 4,098,103 | * | 7/1978 | Raskevicius | 70/494 |
| 4,208,894 | * | 6/1980 | Surko, Jr. | 70/494 |
| 4,222,252 | * | 9/1980 | Tietz | 70/378 X |
| 4,235,086 | * | 11/1980 | Genakis | 70/494 |
| 4,723,427 | * | 2/1988 | Olivev | 70/494 |
| 5,131,249 | * | 7/1992 | Badeu et al. | 70/398 |
| 5,457,974 | * | 10/1995 | Keller | 70/409 X |
| 5,502,991 | * | 4/1996 | Sørnes | 70/494 X |
| 5,570,601 | * | 11/1996 | Field | 70/494 X |
| 5,682,779 | * | 11/1997 | Dolev | 70/409 X |
| 5,839,308 | * | 11/1998 | Eizen et al. | 70/409 X |
| 5,931,036 | * | 8/1999 | Keller | 70/495 |

FOREIGN PATENT DOCUMENTS

| | | | | |
|---|---|---|---|---|
| 1093253 | * | 11/1960 | (DE) | 70/493 |
| 431550 | * | 6/1991 | (EP) | 70/409 |
| 2492872 | * | 4/1982 | (FR) | 70/409 |
| 7317470 | * | 3/1975 | (NL) | 70/409 |
| WO87/04749 | * | 8/1987 | (WO) | 70/494 |

* cited by examiner

*Primary Examiner*—Lloyd A. Gall
(74) *Attorney, Agent, or Firm*—Edward Langer, Pat. Atty.

(57) ABSTRACT

A cylinder lock has a plug deployed within a bore in a cylinder housing. The plug defines a keyway which communicates with a number of pin channels. Disposed within the channels are a number of pins which are displaceable along, and rotatable about, their axis. Each pin has an engagement end, proximal to the keyway, formed with at least two engagement features projecting parallel to, but displaced from, the pin's axis, and separated by at least one depression. Each pin is free to rotate through 360° about it axis. The cylinder lock preferably also includes a key for insertion into the keyway. The key has a seat located to come into alignment with a pin, the seat being formed with at least two depressions separated by an intermediate ridge. The configuration of the seat is such that the pin is rotated by contact with the seat to an angularly aligned position in which its engagement features are aligned with the depressions of the seat.

16 Claims, 13 Drawing Sheets

22
150.00°

10
14
22

14

22

12b
12a
10

45.00°
90.00°
16
12b 120.00°
16
12a

CYLINDER LOCK WITH ROTATABLE PINS

FIELD AND BACKGROUND OF THE INVENTION

The present invention relates to cylinder locks and, in particular, it concerns cylinder locks which employ pins which are rotatable.

Cylinder locks can be broadly subdivided into conventional or "Yale-type" locks in which the key has a jagged edge and flat-key locks in which a generally flat key features various patterns of depressions. In both cases, the various features of the key serve to displace a number of pins, generally in a direction perpendicular to the direction of insertion of the key, to predefined positions which allow rotation of the cylinder.

In order to increase the number of "combinations", and hence the security, of a lock, various Yale-type locks have been designed to allow rotation as well as displacement of the pins. In this case, the pins typically have a chisel-like end for engaging slightly angled recesses in the jagged pin-engaging edge. Examples of such designs may be found in U.S. Pat. Nos. 3,499,303 to Spain, 3,722,240 to Spain et al., 4,098,103 to Raskevicius, 4,328,690, 4,635,455 and Re. 31,910 to Oliver, Re. 30,198 to Oliver et al., 4,741,188 to Smith, 4,932,229 to Genakis and 5,067,335 to Widen.

Clearly, the range of angles which can be effectively defined by the shape of a recess in the jagged edge of a narrow key are extremely limited, typically lying within a range of at most ±20° from the perpendicular to the insertion direction. To avoid the possibility that the chisel-like ends of the pins could sit at an angle from which the shape of the key might not return them to the required angular position, rotation of the pins is limited to corresponding range of angles. This is typically achieved by a retaining element engaged in a slot around part of the periphery of each pin.

In the context of flat-key cylinder locks, PCT Publication No. WO 96/27724 discloses a number of configurations which employ rotatable pins. The main features of these configurations will now be described with reference to FIGS. 1–6. Specifically, FIGS. 1 and 2 show the disclosed form of flat key 10 which is formed with a number of pin-engaging seats 12. As seen in the enlarged view of FIG. 2, each seat 12 is formed as a fairly short slot extending at a given angle to the direction of insertion. The slots have an approximately V-shaped cross-section with rounded ends. The corresponding cylinder structure is shown in FIG. 3 while FIG. 4 shows an individual pin 14 therefrom. Pin 14 has a chisel-shaped end 16 similar to that described above in the context of Yale-type locks.

Unlike Yale-type locks, the direction of extension of the slots in a flat key are not inherently limited to a small range. Thus, key 10 may feature seats 12 with slots at angles ranging from approximately parallel to the extensional direction to approximately perpendicular thereto. At the same time, it should be noted that any given direction of slot is only effective to rotate a pin to the corresponding angle if the pin starts within a relatively small range of angles therefrom. The reasons for this will be apparent from FIGS. 5A–5C.

Specifically, referring to the enlargement of a shallow seat 12*a* in FIG. 5B, it will be seen that, over a large range of angles corresponding to as much as 120°, the crest of the chisel-shaped end 16 of pin 14 (represented by dashed lines) catches on the flat part of the key surface surrounding the slot such that the slot is ineffective to turn the pin. Even for a deeper seat 12*b* as shown in FIG. 5C, the pin-slot geometry may be ineffective to turn the pin to the correct position from initial positions over a range of as much as 90°. Since the pin is restricted to rotation about its axis, the end of the pin only experiences a component of the inclination of the slot walls parallel to a tangent taken at the point of contact about the pin's axis. Since the local inclination of the walls of the slot is directed perpendicular to the length of the slot, any significant initial misalignment between the pin and the slot greatly reduces the effect of the slot inclination for turning the pin. As a result, the proposed cylinder structure illustrated in FIG. 3 provides a projecting ridge 18 on each pin 12 which engages a peripheral slot 20 around part of the pin channel to delimit rotation of each pin to a range of no more than about 60–80° including the required position.

The restriction of pins to a specific range of angular positions has a number of disadvantages. Firstly, the additional features required on both the pins and within the cylindrical plug add considerably to the cost of manufacture. Additionally, the restricted angular positions greatly limit the number of different combinations which can be achieved with a given number of pins, thereby reducing the level of security unnecessarily. The restricted angular movement also facilitates picking of the lock, particularly for pin angles adjacent to the ends of the available movement.

Parenthetically, reference is here made to FIGS. 6A–6D which illustrate an alternative implementation of the aforementioned PCT Publication No. WO 96/27724 in which the V-shaped slot is implemented on the end of pin 14 (FIG. 6B) while the chisel-shaped ridge is implemented as a ridged insert 22 (FIG. 6A) for insertion into a recess of key 10 as shown in FIG. 6C. Insert 22 may be formed with a transverse slot as shown to allow a user to set its angle by use of a screwdriver tool. Here too, the proper operation of the slot-ridge geometry is limited to a narrow range of angles, as indicated in FIG. 6D.

Referring again to FIG. 3, it will be noted that the lock of PCT Publication No. WO 96/27724 employs a sidebar 24 which engages a slot running along the inside of the cylinder housing to prevent rotation of the cylinder plug until all pins are aligned. This structure, predominant also in the Yale-type rotating pins locks mentioned above, exhibits weakness against forces exerted parallel to the cylinder axis. Where conventional driver pins aligned with the pins are used in addition to the sidebar, this problem is not critical. In the absence of driver pins, however, such locks are prone to attack using a pulling extractor tool.

Turning finally to FIGS. 7 and 8, there is shown a further feature disclosed in PCT Publication No. WO 96/27724 in which a pin is raised to a position lying outside the keyway of the cylinder. This is achieved by providing the key with a "floating pin" 26 which is effectively a movable insert mounted in a hole formed through the key so as to be displaceable so as to project above the surface of the key. The cylinder is fitted with a spring-biased actuator 28 opposite the pin in question so that, when the key is inserted, actuator 28 displaces floating pin 26 so as to make pin 14 retract along its channel to a position lying outside the keyway.

While the floating pin assembly makes unauthorized copying of keys difficult, it does so at great cost. Firstly, the assembly requires significant modification of the cylinder to provide the actuator 28, thereby adding to production costs. Additionally, the assembly may facilitate picking of the lock since actuator 28 readily identifies both the presence and position of a pin which must be displaced to a position lying outside the keyway.

There is therefore a need for a flat-key cylinder lock which would allow the use of pins which can turn unrestricted through 360°, and effective pin and key geometries for use in such a lock. It would also be highly advantageous to provide a flat-key cylinder lock with rotatable pins which would avoid the use of a sidebar. Finally, it would be highly advantageous to provide a flat-key structure which would raise a pin to a position lying outside the keyway without requiring significant modification of the cylinder structure.

SUMMARY OF THE INVENTION

The present invention is a flat-key cylinder lock which employs pins which can turn unrestricted through 360°. The present invention also provides keys for use with such locks and keys employing a pin-biasing assembly.

According to the teachings of the present invention there is provided, a cylinder lock comprising: (a) a cylinder housing defining a bore; (b) a plug deployed within the bore, the plug defining a keyway and at least one pin channel communicating with the keyway; and (c) at least one pin disposed in the at least one pin channel so as to be displaceable along, and rotatable about, a pin axis, the pin having an engagement end proximal to the keyway, wherein the engagement end is formed with at least two engagement features projecting parallel to, but displaced from, the pin axis, the at least two engagement features being separated by at least one depression, and wherein the pin is free to rotate through 360° about the pin axis.

According to a further feature of the present invention, a first of the at least two engagement features projects further parallel to the pin axis than a second of the at least two engagement features.

According to a further feature of the present invention, the plug further features at least one lateral channel communicating with the pin channel, the cylinder housing further features an engagement aperture alignable with the lateral channel, and the pin features an alignment aperture, the lock further including a side rod deployed within the at least one lateral channel and displaceable between a locking state engaged within the engagement aperture, thereby opposing both rotation and axial displacement of the plug relative to the cylinder housing, and a free state in which a part of the side rod is engaged within the alignment aperture, thereby allowing relative rotation of the plug relative to the cylinder housing.

According to a further feature of the present invention, there is also provided a key configured for insertion into the keyway, the key having a seat located to come into alignment with the pin, the seat being formed with at least two depressions separated by an intermediate ridge and configured such that the pin is rotated by contact with the seat to an angularly aligned position in which the engagement features are aligned with the depressions.

According to a further feature of the present invention, the seat and the engagement features are configured such that contact between the pin and the seat is effective to rotate the pin to the angularly aligned position from an arbitrary initial relative angular position anywhere within a range of at least about 160°, and preferably at least about 170°.

According to a further feature of the present invention, the ridge corresponds to a line of intersection between surfaces of the at least two depressions.

According to a further feature of the present invention, the at least two engagement features terminate in rounded end portions.

According to a further feature of the present invention, the at least two depressions include two, substantially conical, intersecting depressions.

According to a further feature of the present invention, the key features a pin-engaging face, the seat being spring-biased to a raised position projecting above the pin-engaging face so as to displace the pin to a position in which the engagement end lies outside the keyway.

There is also provided according to the teachings of the present invention, a flat key for use with a cylinder lock of a type having rotatable pins which must be rotated to a given rotational position to effect unlocking of the cylinder lock, the key comprising: a key shaft configured for insertion into the cylinder lock along a direction of insertion, the key shaft having at least one pin-engaging face which features a plurality of recessed seats, each of the plurality of recessed seats being configured to rotate a pin to a given rotational position relative to the direction of insertion, wherein each of the plurality of recessed seats is formed with at least two similar depressions intersecting along a line so as to form an intermediate ridge.

According to a further feature of the present invention, the intermediate ridge of a first of the recessed seats extends in a first direction, the intermediate ridge of a second of the recessed seats extending in a second direction non-parallel to the first direction.

According to a further feature of the present invention, the depressions of a first of the recessed seats have a first maximum depth, the depressions of a second of the recessed seats having a second maximum depth greater than the first maximum depth.

There is also provided according to the teachings of the present invention, a flat key for use with a cylinder lock of a type having a keyway and at least one pin which must be displaced to a position in which it lies entirely outside the keyway, the key comprising: (a) a key shaft configured for insertion into the cylinder lock along the keyway, the key shaft having at least one pin-engaging face which features a recess; and (b) at least one pin-biasing assembly mounted within the recess and providing a pin-engaging seat, the pin-engaging seat being spring-biased to a raised position projecting above the pin-engaging surface and being retractable to a depressed position lying substantially level with the pin-engaging surface.

According to a further feature of the present invention, the pin-biasing assembly includes a leaf spring.

According to an alternative feature of the present invention, the pin-biasing assembly includes a helical spring.

According to a further feature of the present invention, the pin-engaging seat features at least two depressions separated by an intermediate ridge and configured to rotate a pin to a given rotational position. When this feature is implemented using a helical spring, the recess and the pin-biasing assembly are preferably provided with complementary slidingly-interlocking features configured to prevent rotation of the pin-biasing assembly relative to the key shaft.

BRIEF DESCRIPTION OF THE DRAWINGS

The invention is herein described, by way of example only, with reference to the accompanying drawings, wherein.

DESCRIPTION OF THE PREFERRED EMBODIMENTS

Figures 1, 2:
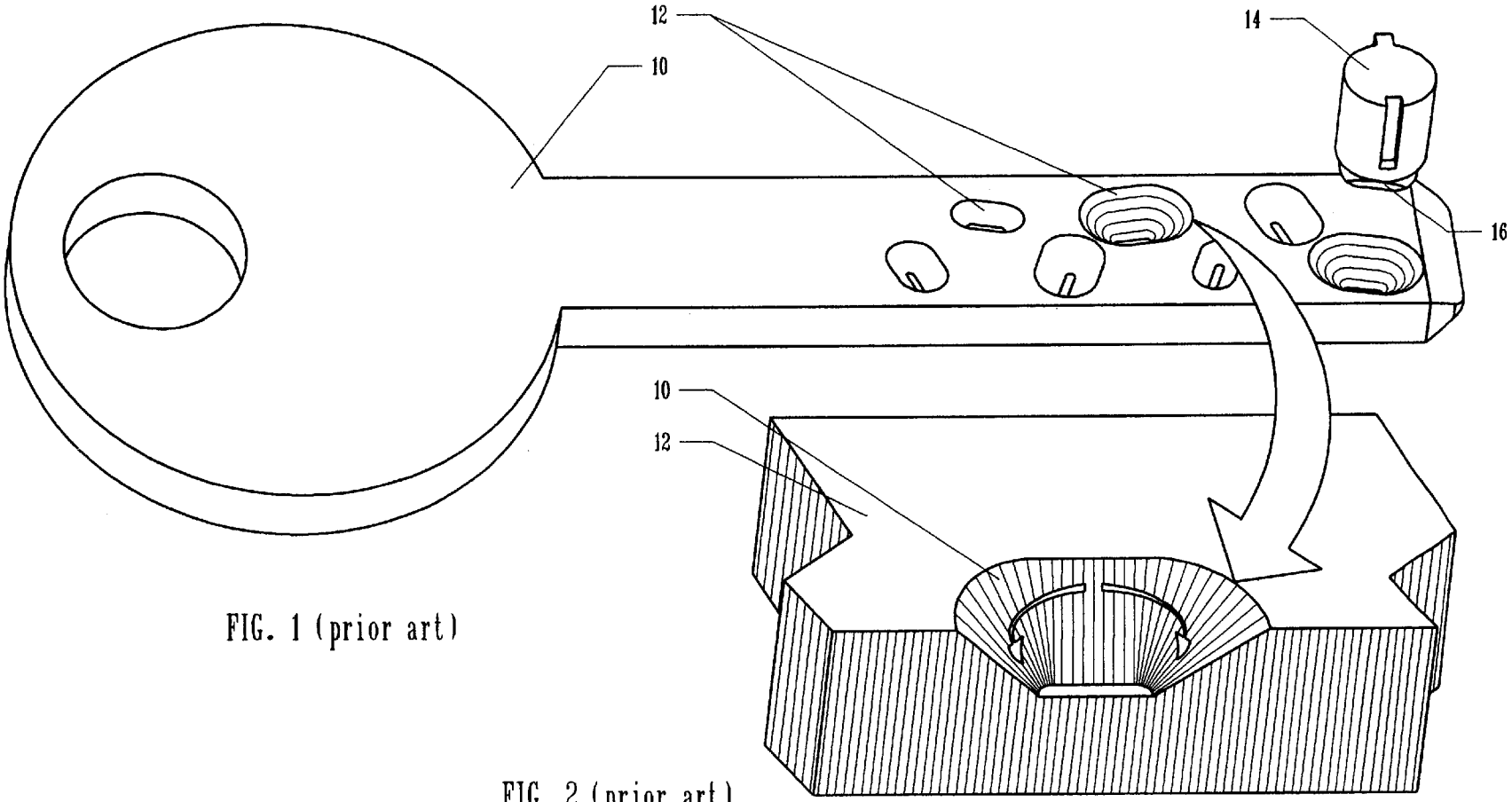
FIG. 1 (prior art)
FIG. 2 (prior art)
FIG. 1 is a schematic isometric view of a flat key and corresponding pin as taught by PCT Publication No. WO 96/27724.
FIG. 2 is an enlarged, partially cut-away view of a slot from the key of FIG. 1.
Figure 3:
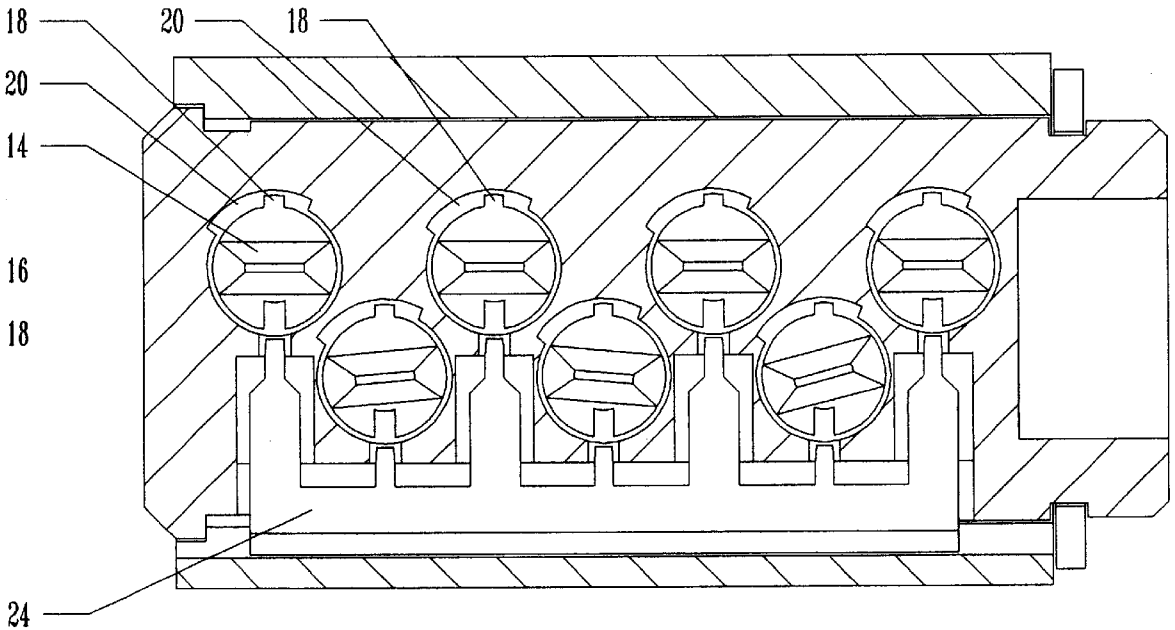
FIG. 3 (prior art)
FIG. 3 is a cross-sectional view taken through a lock cylinder as taught by PCT Publication No. WO 96/27724.
Figure 4:
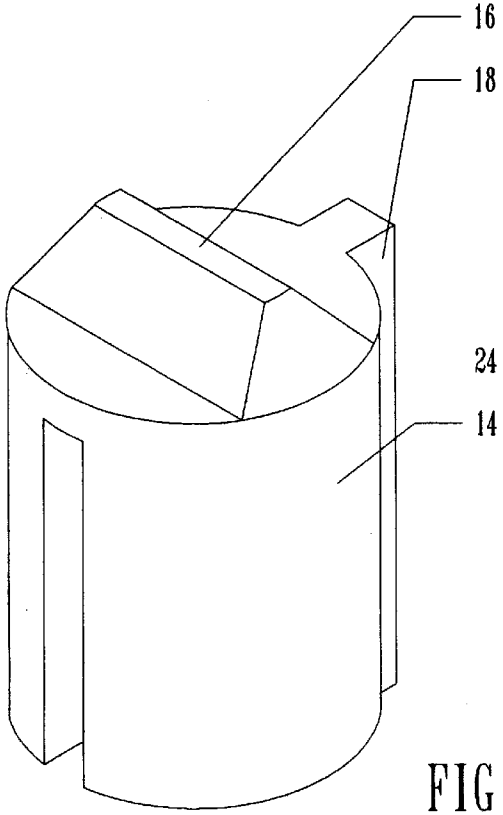
FIG. 4 (prior art)
FIG. 4 is an enlarged isometric view of the pin of FIG. 1.
Figures 5A, 5B, 5C, 6A, 6B, 6C, 6D:
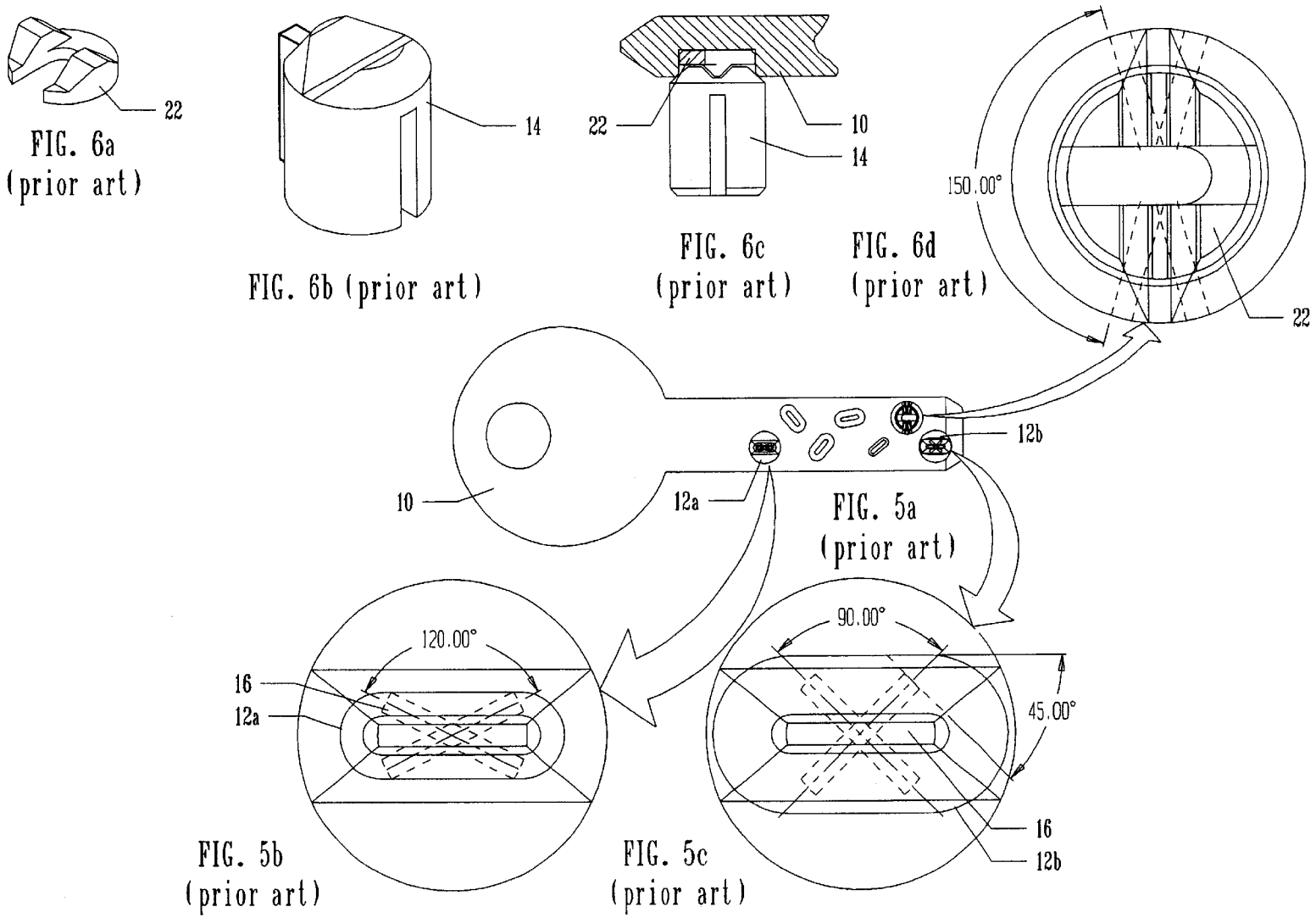
FIG. 6d (prior art)
FIG. 6c (prior art)
FIG. 6b (prior art)
FIG. 6a (prior art)
FIG. 5a (prior art)
FIG. 5c (prior art)
FIG. 5b (prior art)
FIG. 5A is a plan view of a key similar to that of FIG. 1.
FIGS. 5B and 5C are enlarged views of two slots from the key of FIG. 5A.
FIG. 6A is an isometric view of a ridge-forming key insert according to an alternative embodiment of PCT Publication No. WO 96/27724.
FIG. 6B is an isometric view of a slotted-end pin for use with the insert of FIG. 6A.
FIG. 6C is a side cross-sectional view showing engagement of the pin of FIG. 6B against a key including the insert of FIG. 6A.
FIG. 6D is an enlarged view of a slot from the key of FIG. 5A employing the insert of FIG. 6A.
Figure 8:
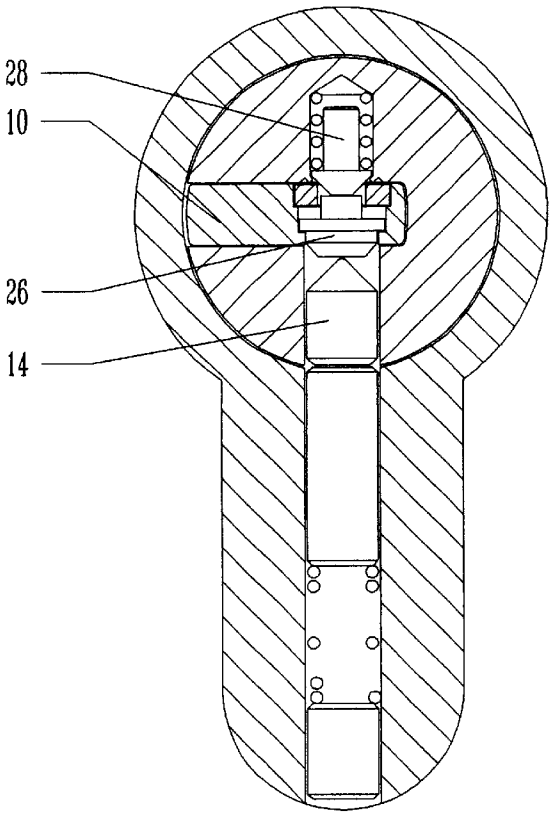
FIG. 8 (prior art)
FIG. 8 is a cross-sectional view taken along line VIII—VIII of FIG. 7.
Figure 7:
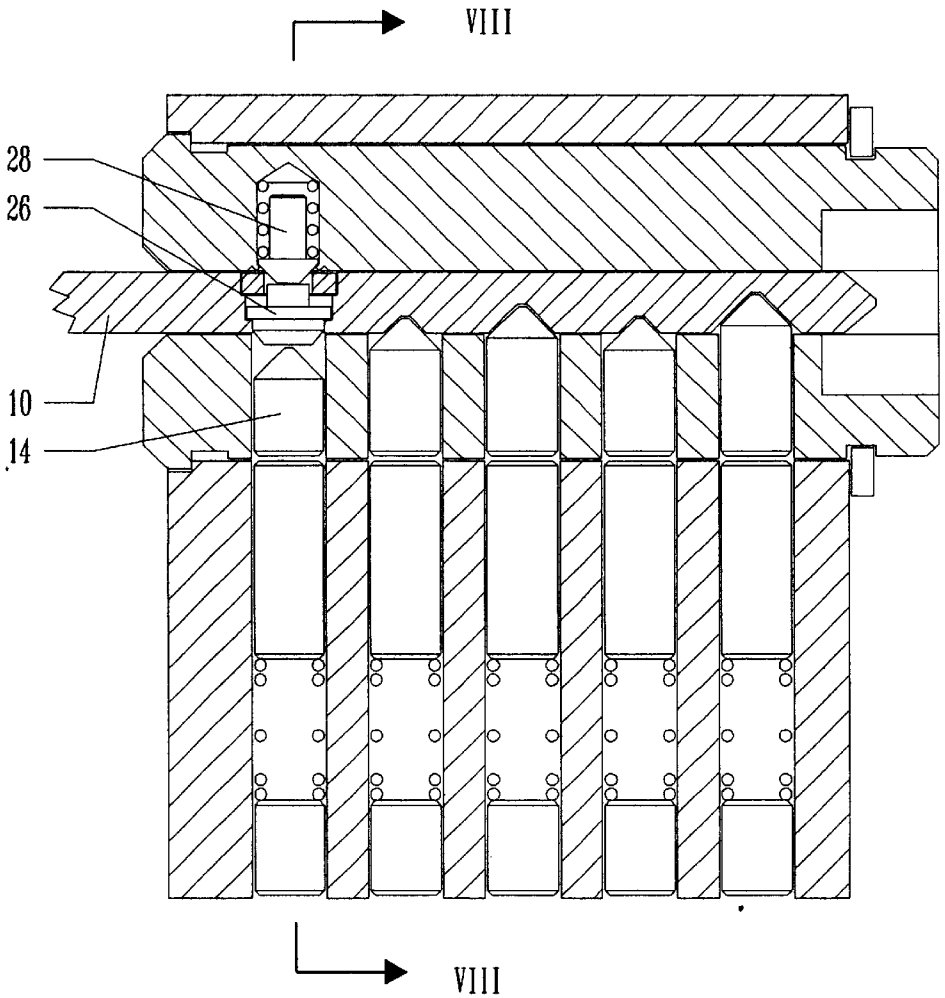
FIG. 7 (prior art)
FIG. 7 is a cross-sectional view through a lock cylinder taken parallel to its axis illustrating a floating-pin feature of PCT Publication No. WO 96/27724.

The present invention is a flat-key cylinder lock which employs pins which can turn unrestricted through 360°. The present invention also provides keys for us with such locks and keys employing a pin-biasing assembly.

The principles and operation of keys and locks according to the present invention may be better understood with reference to the drawings and the accompanying description.

Referring now to the drawings, FIGS. 9–20 illustrate a first embodiment of a cylinder lock 30 and corresponding key 32, constructed and operative according to the teachings of the present invention.

Before addressing the specific features of cylinder lock 30 and key 32, it should be noted that it is a particular feature of most preferred embodiments of the present invention that the cylinder lock employs pins which are free to rotate through 360°, thereby avoiding the problems of high production costs and reduced security described above in the context of the prior art. Accordingly, preferred implementations of the present invention provide pins and keys with complementary engagement features which are configured to rotate each pin to a required angular position from a wide range of initial angular positions. These complementary engagement features will now be described with reference to FIGS. 9–14.

Figures 9, 10:
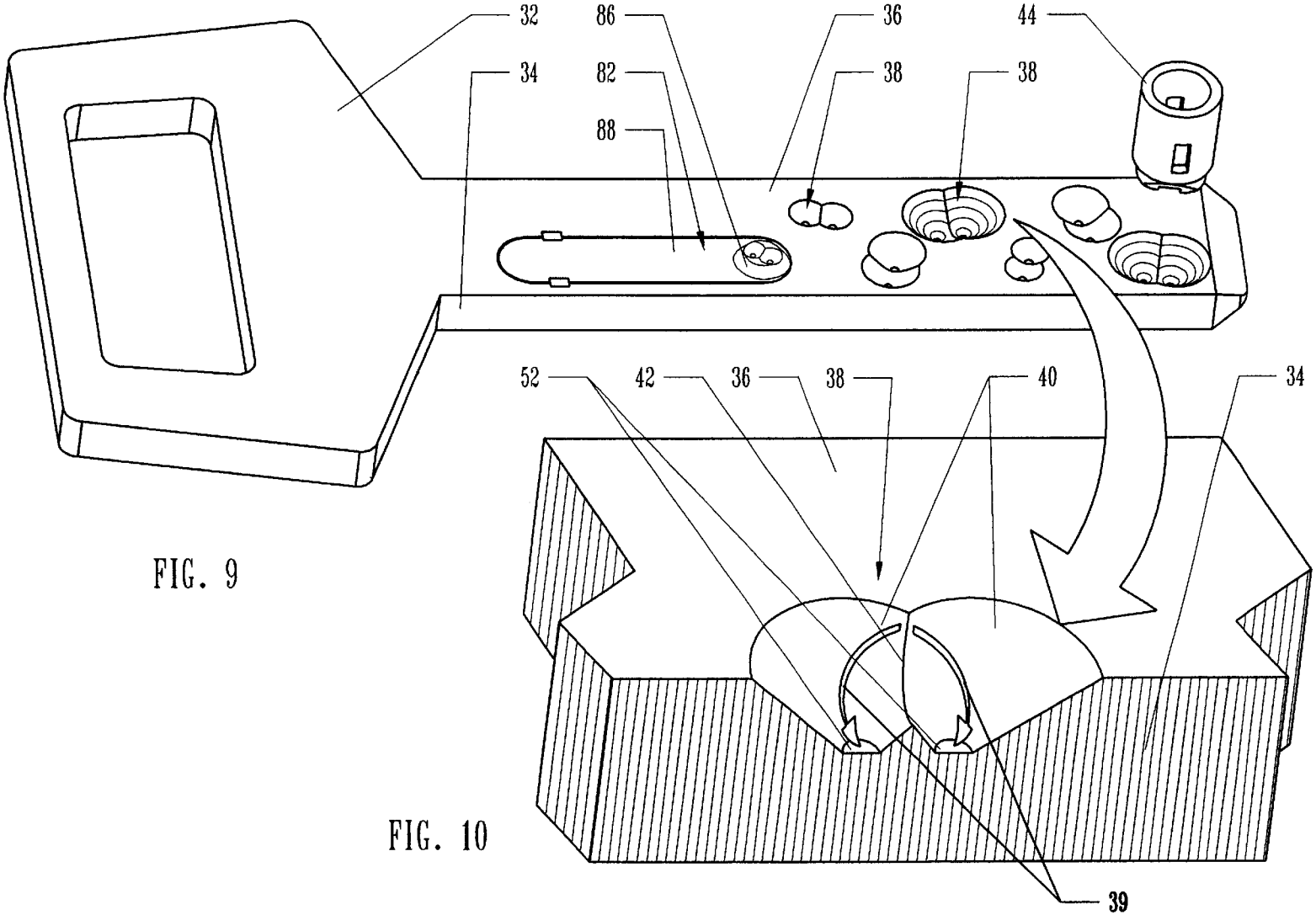
FIG. 9 is a schematic isometric view of a flat key, constructed and operative according to the teachings of the present invention.
FIG. 10 is a partially cut-away enlargement of a part of the key of FIG. 9 showing a preferred form of pin-engaging seat.

Thus, FIG. 9 shows a preferred form of key 32 for use with a cylinder lock of a type having rotatable pins which must be rotated to a given rotational position to effect unlocking of the cylinder lock. In general terms key 32 features a key shaft 34 configured for insertion into the cylinder lock along a direction of insertion. Key shaft 34 has at least one pin-engaging face 36 which features a plurality of recessed seats 38, each configured to rotate a pin to a given rotational position relative to the direction of insertion. As better seen in FIGS. 10 and 12, each recessed seat 38 is formed with at least two depressions 40 intersecting along a line so as to form an intermediate ridge 42.

Figure 11:
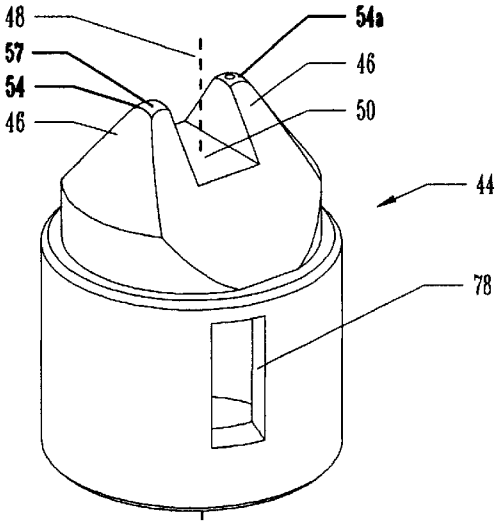
FIG. 11 is an enlarged schematic isometric view of a preferred form of a pin for use with key of FIG. 9.

FIG. 11 shows a preferred form of pin 44 for use in the present invention. Pin 44 is formed with at least two engagement features 46 projecting parallel to, but displaced from, an axis 48 of the pin. Engagement features 46 are separated by at least one depression 50.

Figure 14:
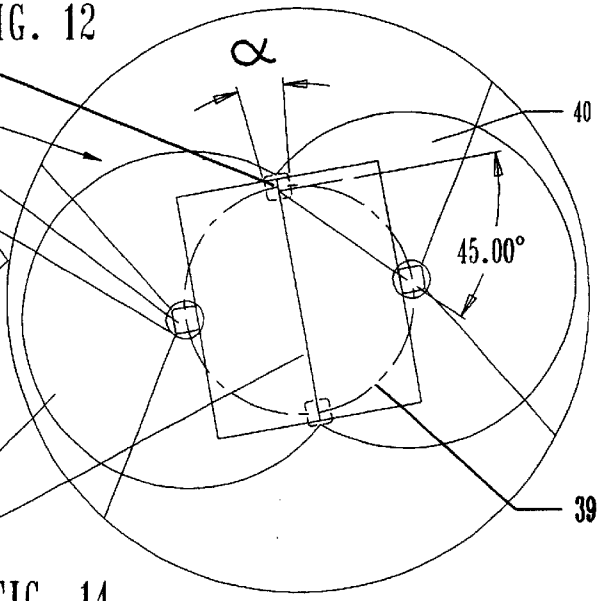
FIG. 14 is an enlarged view of a pin-engaging seat from the key of FIG. 13.
Figure 13:
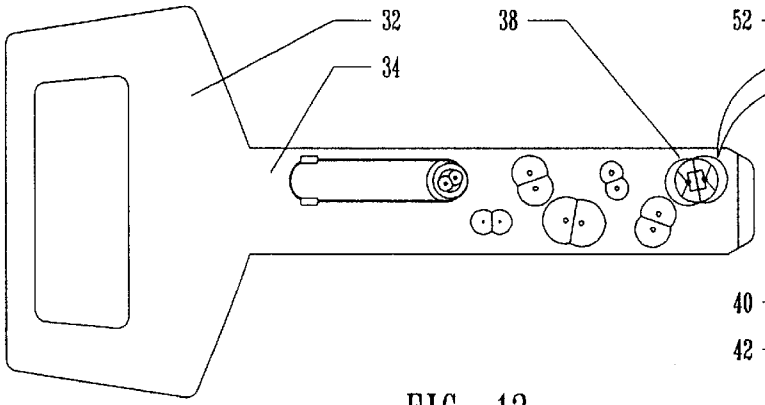
FIG. 13 is a top view of a key similar to that of FIG. 9.

Referring now to FIG. 14, it will be apparent that this preferred geometry of seat 38 and pin 44 provides much more effective aligning forces than the chisel-point and slot structures of the prior art. Specifically, since ridge 42 approximates to a line of intersection between inclined surfaces of depressions 40, and since the ends of projecting features 46 are shaped to subtend a small angle at the axis 48, the likelihood of the projecting features becoming lodged on the ridge is very small. Furthermore, since ridge 42 is bordered by surfaces which are inclined away from the ridge, from almost any initial alignment, engagement features 46 will generally encounter sloped surfaces of depressions 40 which are inclined so as to effectively rotate the pin in the required direction. In a preferred example of conical depressions 40, even when the engagement features fall adjacent to ridge 42, the angle between the direction of inclination and a tangent taken at the point of contact about the pin's axis is less than 45°.

Turning to the form of seats 38 in more detail, it will be noted that, to a large extent, only the parts of depressions 40 coming into contact with engagement features 46 are functionally important. Thus, the main defining features of each seat 38 are that the depth of seat 38 varies around the circular contact profile 39 (see FIG. 10) illustrated in FIG. 14 from a minimum depth at ridge 42 to a maximum depth at a flat base 52 along a circular contact profile 39 (see FIG. 10). Preferably, the maximum depth is the same for both depressions 40 of each seat 38. Additionally, in order to ensure a well defined engaged depth of pin 44 within seat 38, the flat base 52 of each depression 40 has sufficient dimensions to receive one of engagement features 46.

In a preferred implementation, all of the aforementioned features may be provided by cutting two blunt-ended conical depressions of equal depth with a distance between their centers equal to the separation between engagement features 46. This separation is chosen to be sufficiently small to ensure intersection of the depressions to form ridge 42 for even the minimum intended depth of depressions.

As mentioned above, it is a preferred feature of the present invention that ridge 42 is formed along a line of intersection between depressions 40, thereby avoiding any flat upper surface to the ridge. This minimizes the possibility of the pin becoming lodged on top of the ridge. It should be appreciated, however, that ridge 42 need not be a sharp edge. Some degree of rounding occurs naturally during use of the key. Optionally, the ridge may be additionally modified, such as by further rounding, without adversely affecting the required properties of the ridge. In all such cases, the ridge is referred to as approximating to a line of intersection between inclined surfaces of depressions 40.

The double-conical implementation of seat 38 is described as the preferred implementation, having been found particularly effective and simple to produce. However, it should be clearly understood that the invention is not limited to such an implementation. Other feasible implementations include, but are not limited to, somewhat rounded near-conical depressions, intersecting round-bottomed depressions and intersecting cylindrical bores cut at angles inclined towards or away from each other.

Turning now to pin 44, engagement features 46 are preferably formed such that contact with inclined surfaces of depressions 40 occurs primarily or exclusively at their end portions 54, 54*a* (see FIG. 11). The end portions 54, 54*a* should also be formed to abut flat bases 52 so as to produce a well defined depth and angle of engagement. The dimensions and shape of end portions 54, 54*a* are preferably chosen such that they have a contact point 57 which subtends a relatively small angle $\alpha$, on ridge 42 typically no more than about 20° and preferably no more than about 10°, to axis 48 as shown in FIG. 14. This ensures that pin 44 will be effectively turned to its intended angular position without catching on ridge 42 from initial positions anywhere in two angular ranges of at least about 160°, and preferably at least about 170°.

Other than the aforementioned preferred features, the particular choice of shape for engagement features 46 is generally not critical. In this context, it should be appreciated that engagement features 46 are described as "projecting parallel to axis 48" to indicate that the end portions 54, 54*a* are the most extreme parts of pin 44 as measured parallel to axis 48. This terminology should not be taken to imply any particular geometrical feature parallel to the axis. In the preferred example shown, the engagement features are generated by a particularly straightforward series of matching operations. Specifically, a conical end is cut along two converging planes and the resulting blunt chisel-edge is slotted transversely to form depression 50. Preferably, the pin is processed by conventional burr-removing techniques such as by vibration until end portions 54 become significantly rounded (se FIG. 11). This rounding, in combination with the narrow form of ridge 42, renders any transverse resting position of the pin on the ridge unstable. As a result, any slight movement of the key will result in the pin being displaced from this position and sliding into proper engagement within seat 38.

Figure 15:
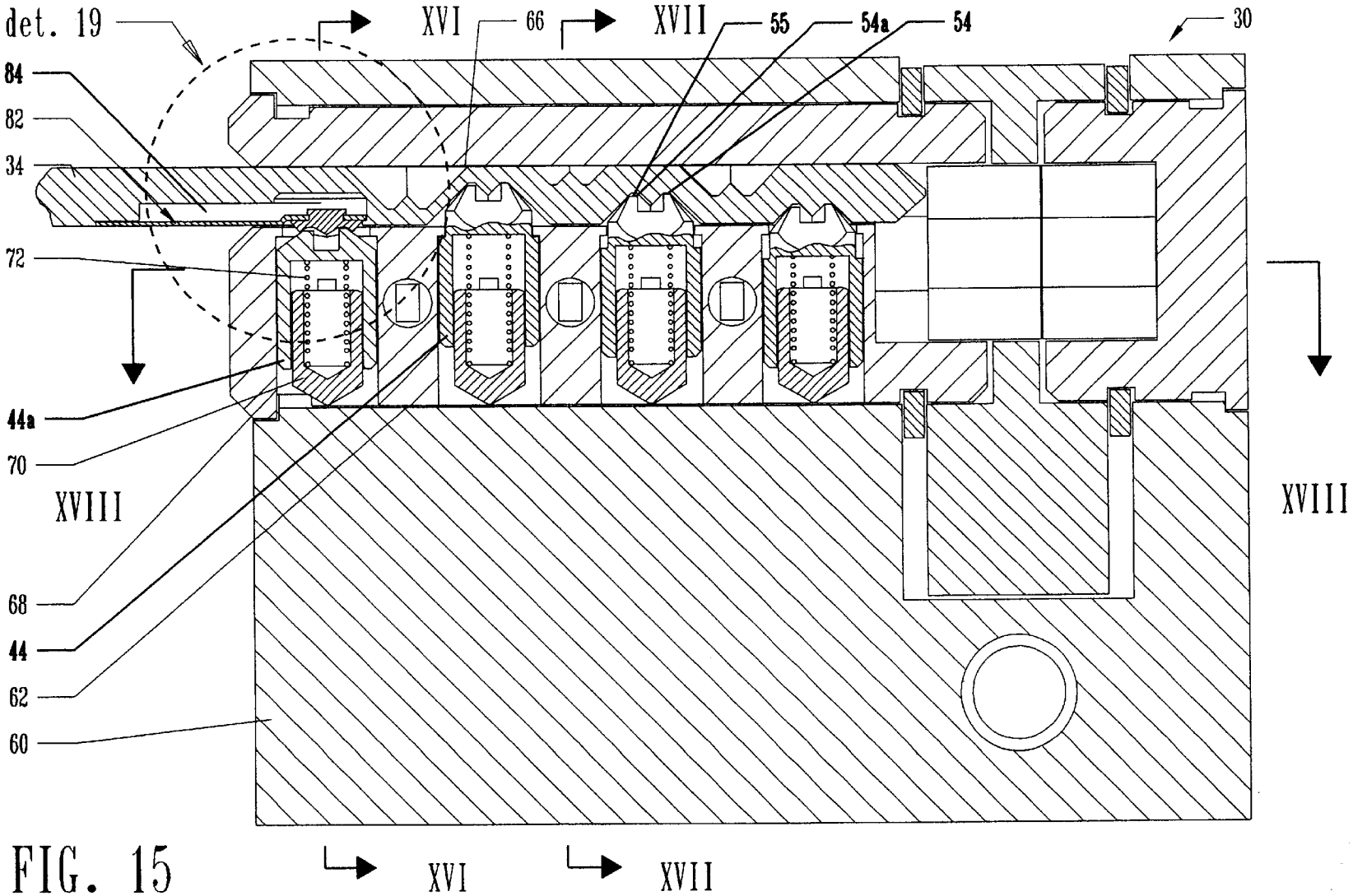
FIG. 15 is a cross-sectional view taken parallel to the axis of a lock cylinder, constructed and operative according to the teachings of the present invention, for use with the key of FIG. 9.

Optionally, one of the end portions 54*a* may be formed so as to be longer than the other end portion 54*a* along an axis 48, developing a gap 55 between end portion 54*a* and depression 40 (see FIG. 15). This helps to ensure that friction caused by insertion or removal of a key tends to turn the pin, helping to dislodge it in the unlikely case the pin were to be caught in an intermediate angular position.

Turning now to FIGS. 15–18, there is shown a cylinder lock 30 which employs a number of pins 44. Cylinder lock 30 has a cylinder housing 60 which defines a bore 62 within which a plug 64 is deployed. Plug 64 defines a keyway 66 with which a number of pin channels 68 communicate. A pin 44 is disposed within each pin channel 68 with its engagement features proximal to keyway 66. Each pin is deployed so as to be displaceable along, and freely rotatable through 360° about, its axis 48.

It will be readily apparent that the free rotation of pins 44, facilitated by the preferred forms of pin 44 and seat 38 described above, leads both to a considerable structural simplification and a considerable security enhancement over the prior art. Manufacture of both pin 44 and plug 64 are greatly simplified by obviating the need for ridges and slots to delimit "allowed" ranges of rotation. At the same time, the increased available angle for each pin greatly increases the number of available combinations which can be provided.

Turning now to the features of cylinder lock 30 in more detail, in order to minimize frictional resistance to rotation of pins 44 while biasing them towards keyway 66, pins 44 are preferably formed with a hollow cylindrical portion within which a pointed spindle insert 70 is telescopically mounted. A spring 72 acts to open pin 44 away from spindle insert 70 so as to provide the required biasing.

As mentioned earlier, the sidebars employed by the prior art rotating-pin cylinder locks fail to provide adequate opposition to axial forces which may be applied to the lock. This leads the prior art to require a wasteful combination of both driver pins and sidebars to provide acceptable security. Without in any way limiting the present invention to locks without driver pins, it is a particular feature of certain preferred embodiments of the present invention that the sidebars of the prior art are replaced by an arrangement using lateral side rods which are configured to provide adequate locking against axial forces even in the absence of driver pins.

Figure 12:
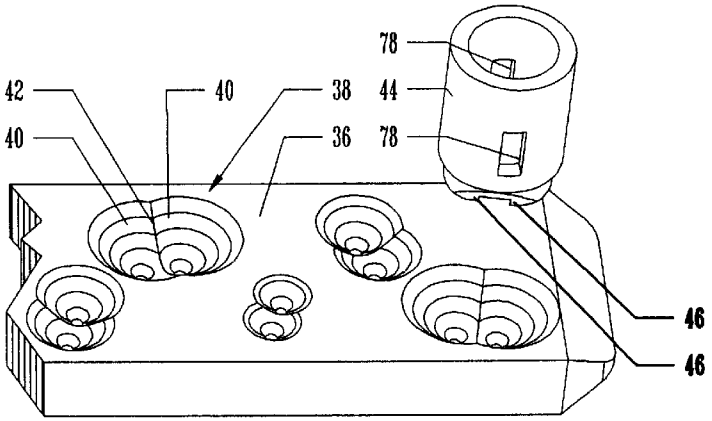
FIG. 12 is an enlarged partial view of the key of FIG. 9 with the pin of FIG. 11 aligned opposite one of its pin-engaging seats.
Figure 17:
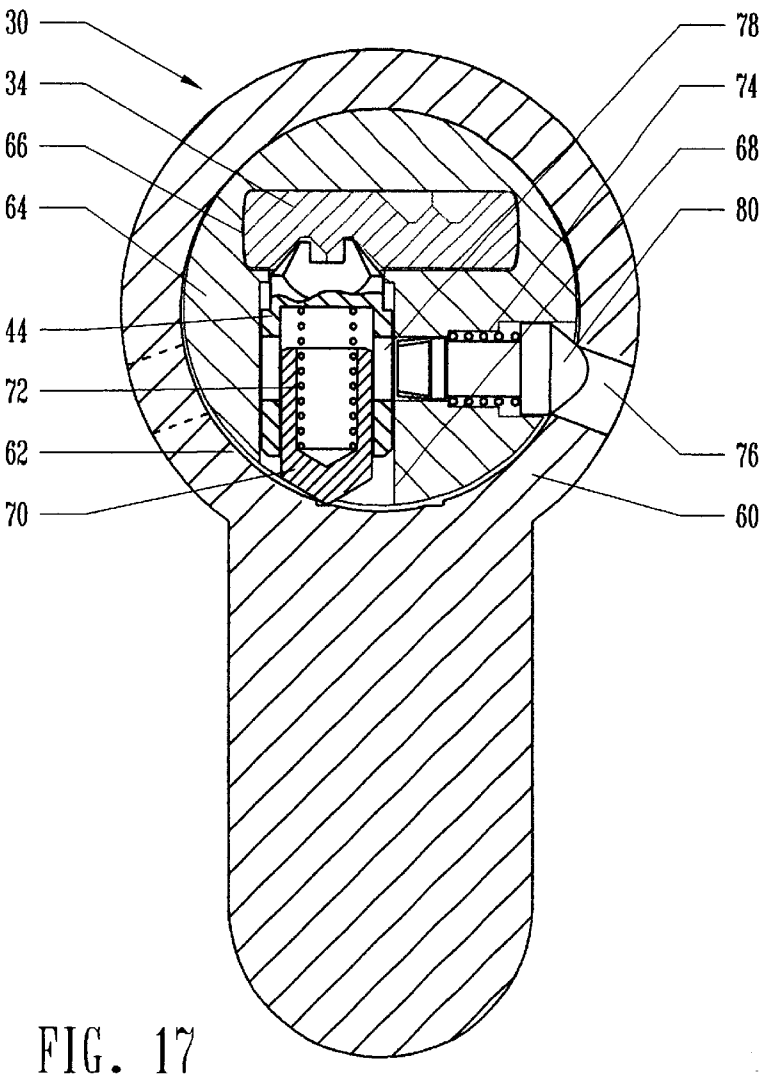
FIG. 17 is a cross-sectional view taken along the line XVII—XVII of FIG. 15.
Figure 16:
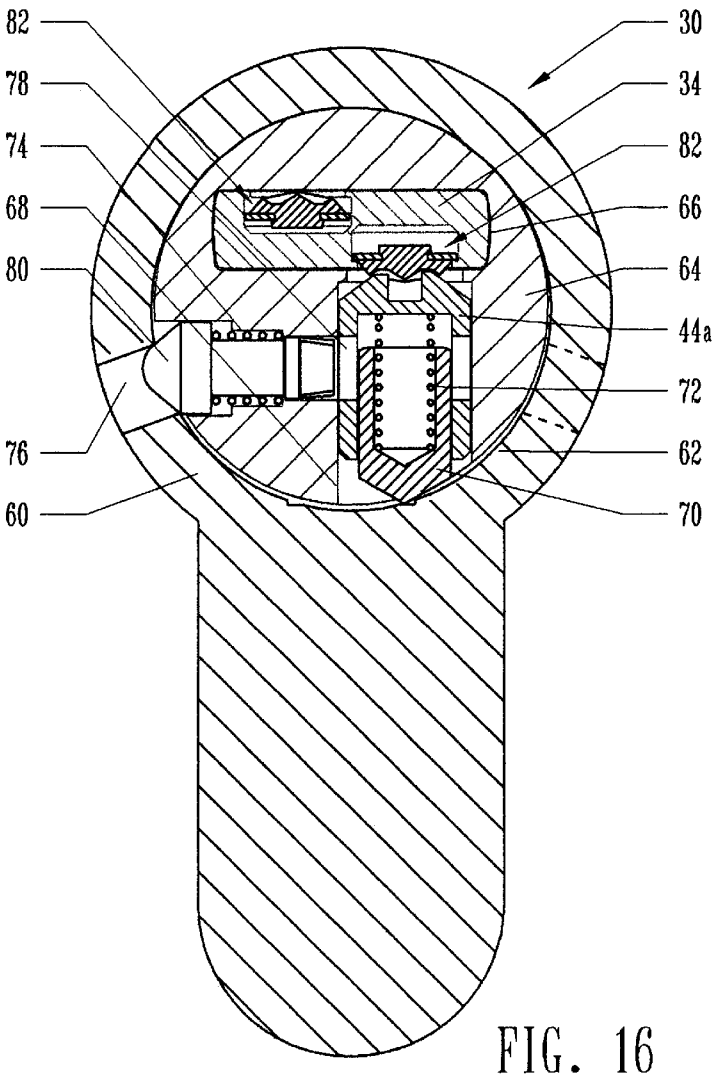
FIG. 16 is a cross-sectional view taken along the line XVI—XVI of FIG. 15.
Figure 18:
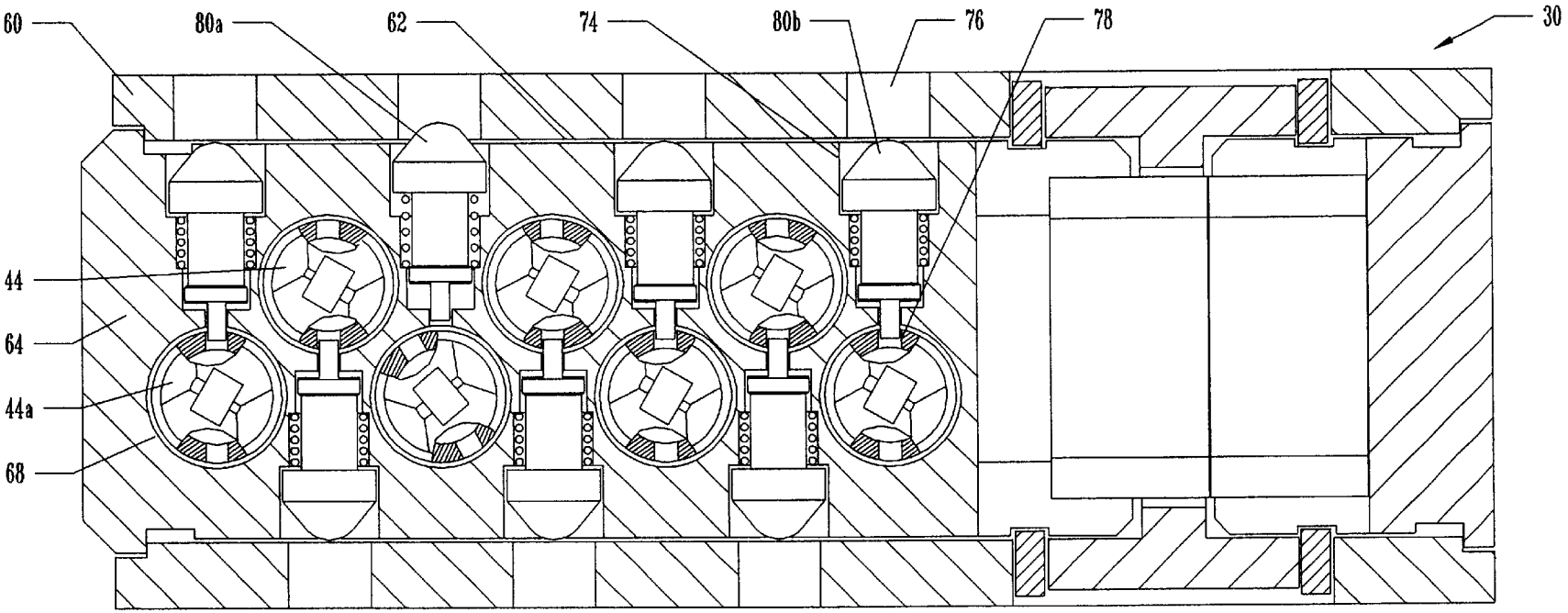
FIG. 18 is a cross-sectional view taken along the line XVIII—XVIII of FIG. 15.

Referring specifically to FIGS. 16–18, plug 64 also features a number of lateral channels 74 aligned laterally with pin channels 68. Aligned with lateral channels 74 are a corresponding number of engagement apertures 76 formed through cylinder housing 60. Additionally, each pin 44 features at least one alignment aperture 78 or, as shown in FIG. 12, a pair of alignment apertures oppositely situated at 180 degrees. Each alignment aperture 78 is positioned in the cylindrical wall of a given pin 44 so as to selectively come into alignment with lateral channel 74 when that pin is located in the particular axial and angular positions generated by an authorized key.

Deployed within each lateral channel 74 is a side rod 80. Side rod 80 is displaceable between a "locking state" and a "free state". In the locking state, illustrated by side rod 80*a* in FIG. 18, the side rod is engaged within the corresponding engagement aperture 76, thereby opposing both rotation and axial displacement of plug 64 relative to cylinder housing 60. Side rod 80 remains trapped in this locking state as long as alignment aperture 78 is out of alignment with lateral channel 74. Then, when pin 44 is brought into its intended axial and angular positions, side rod can be displaced to its free state, illustrated by side rod 80*b* of FIG. 18, in which a part of the side rod is engaged within alignment aperture 78, thereby allowing relative rotation of plug 64 relative to cylinder housing 60.

Clearly, in the preferred case of pins 44 which can rotate freely between two opposite engagement positions, alignment apertures 78 should be formed in opposing pairs. Additional authorized combinations such as for master keys can be added simply by cutting additional pairs of alignment apertures 78 in the appropriate positions.

Turning now to an additional set of features of certain preferred embodiments of the present invention, these relate to the design of flat-keys with a pin-biasing assembly for raising a pin to a position lying outside the keyway without requiring significant modification of the cylinder structure.

Figure 20:
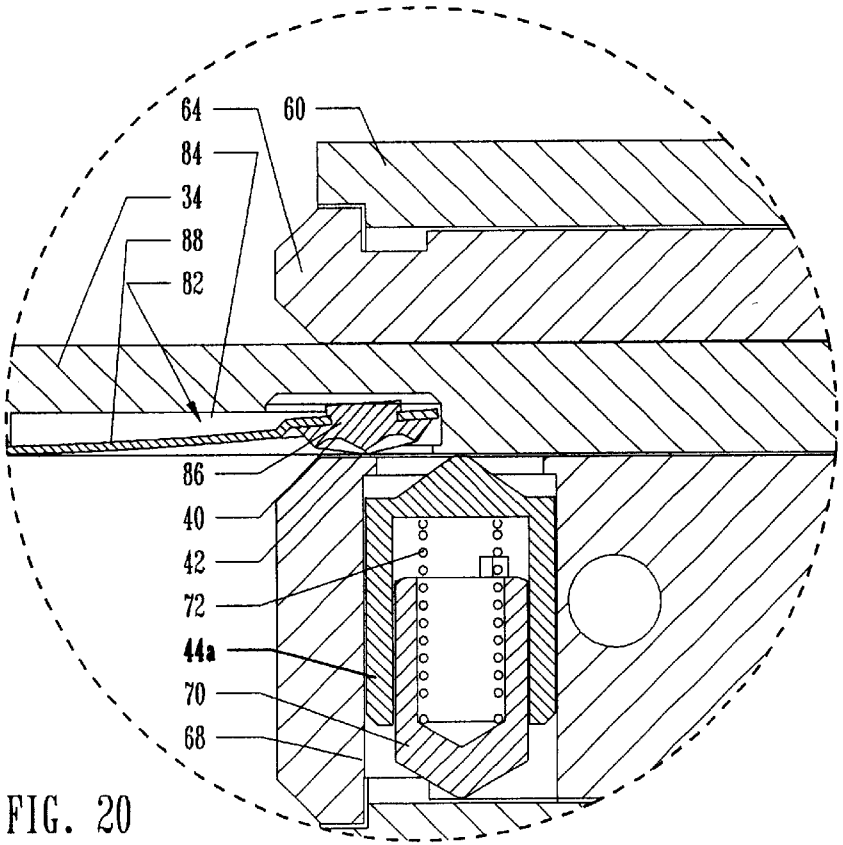
FIG. 20 is a view similar to FIG. 19 showing the position of the pin-biasing assembly during insertion of the key.
Figure 19:
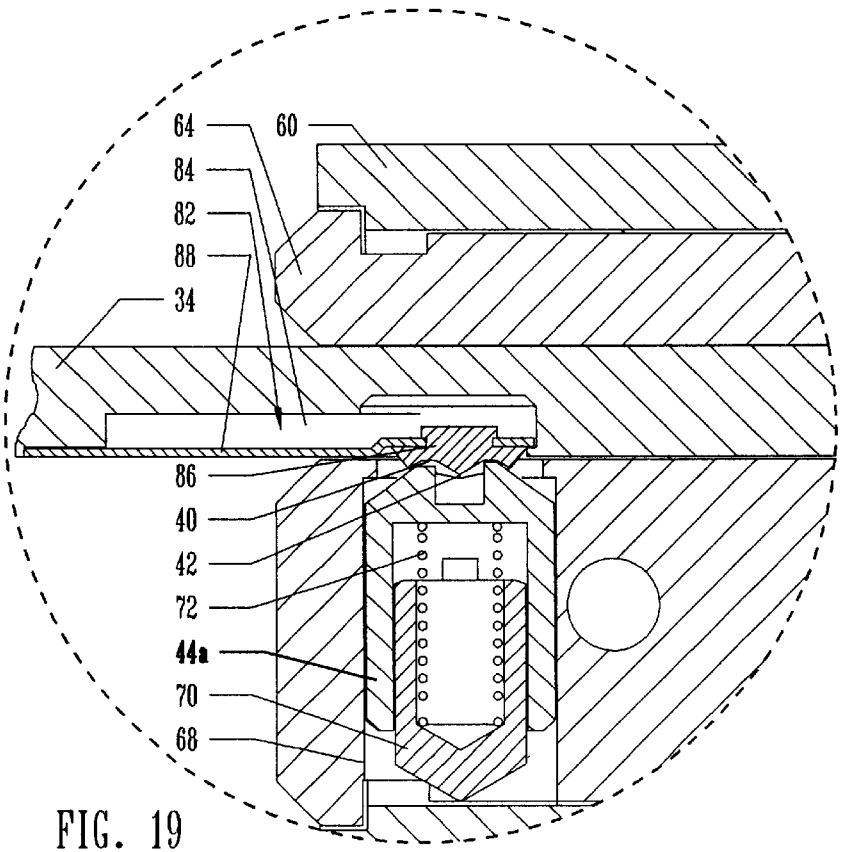
FIG. 19 is an enlarged view of the region identified as "detail 19" in FIG. 15 illustrating a pin-biasing assembly of the key of FIG. 9.
Figure 22:
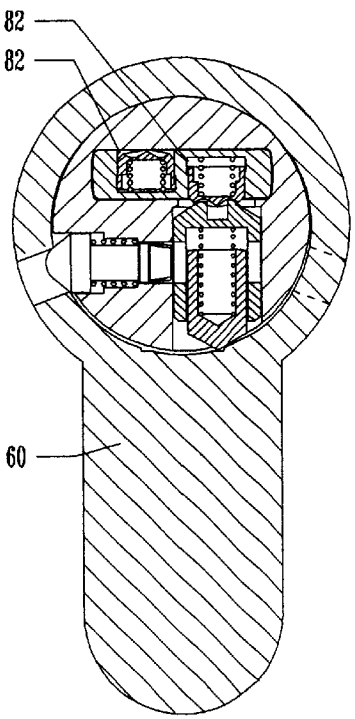
FIG. 22 is a cross-sectional view taken along the line XXII—XXII of FIG. 21.
Figure 21:
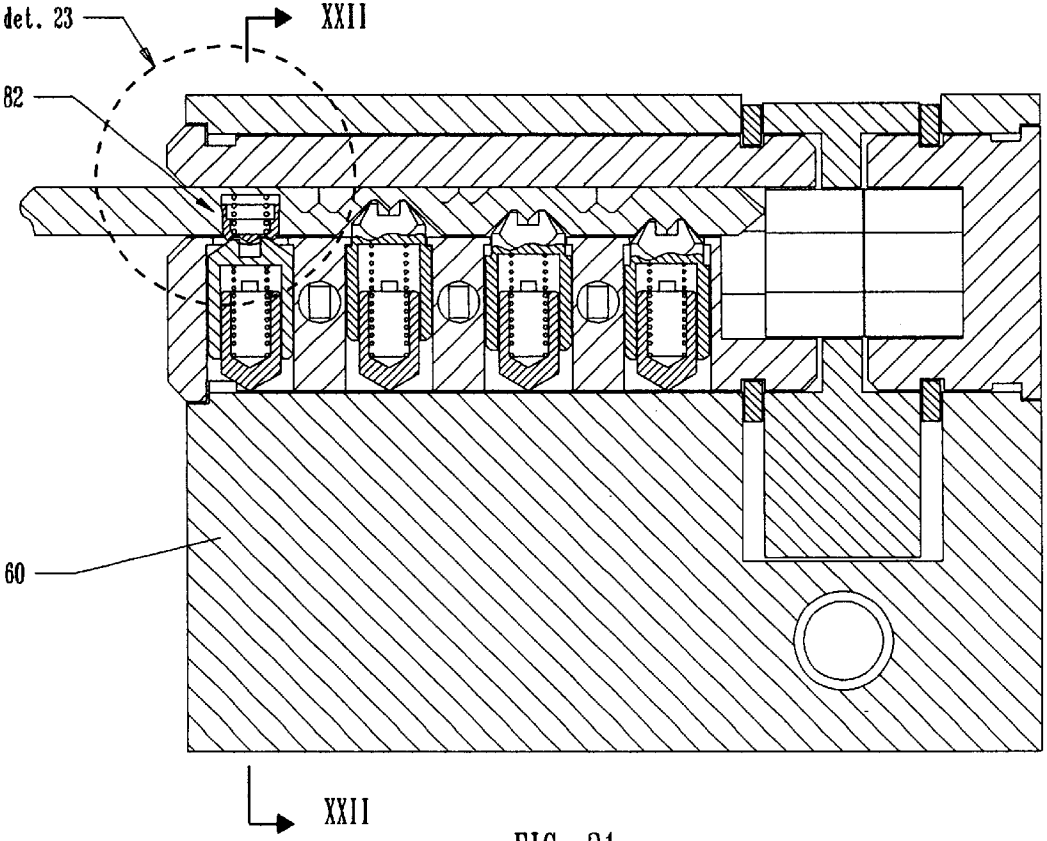
FIG. 21 is a view similar to FIG. 15 illustrating the use of a key with an alternative form of pin-biasing assembly.
Figure 24:
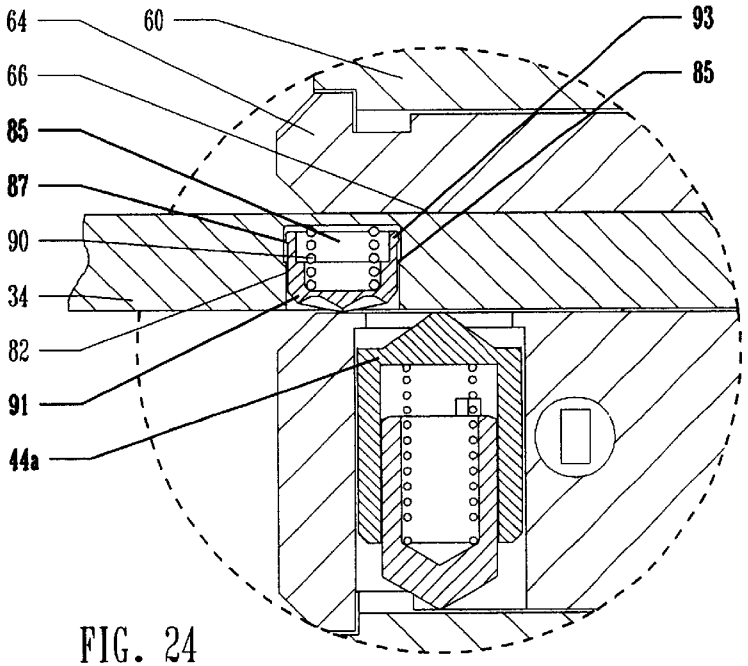
FIG. 24 is a view similar to FIG. 23 showing the position of the pin-biasing assembly during insertion of the key.
Figure 23:
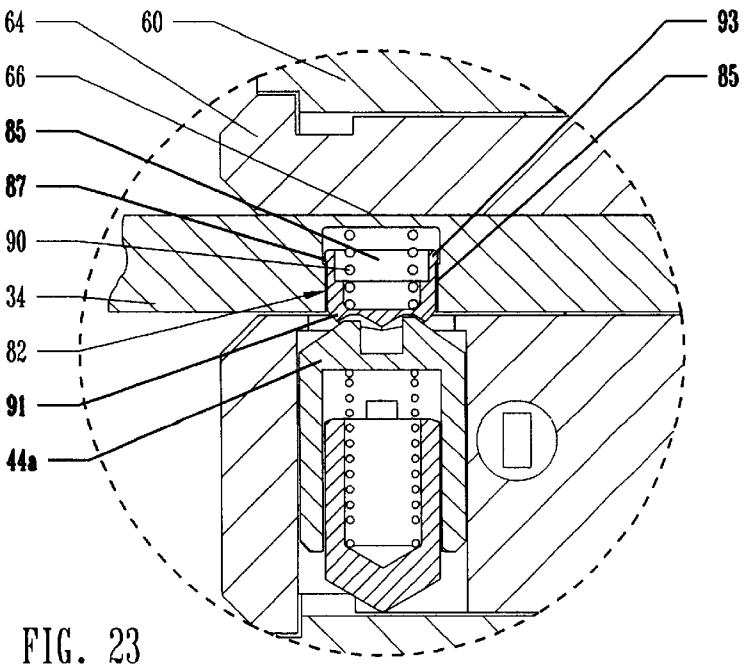
FIG. 23 is an enlarged view of the region identified as "detail 23" in FIG. 21.
Figure 26:
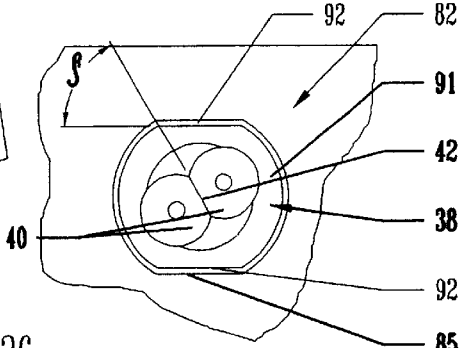
FIG. 26 is an enlarged top view of the pin-biasing assembly of FIG. 25.
Figure 25:
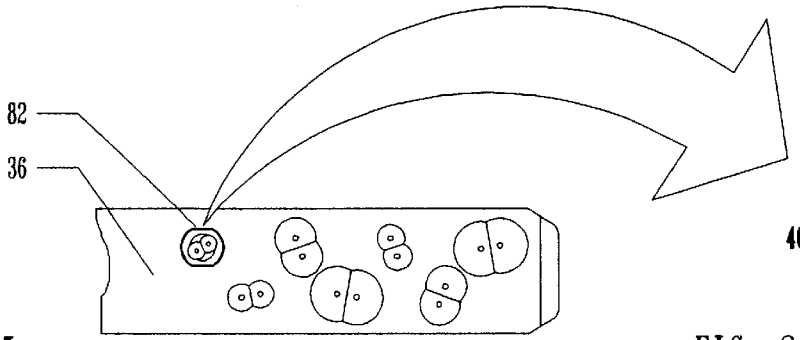
FIG. 25 is a partial top view of the key of FIG. 21.

A first preferred form of pin-biasing assembly 82, visible in FIGS. 9, 13, 15 and 16, is shown more clearly in FIGS. 19 and 20. Generally speaking, key shaft 34 features a recess 84 in pin-engaging face 36. A pin-biasing assembly 82, mounted within recess 84, provides a pin-engaging seat 86. Pin-engaging seat 86 is spring-biased, in this case by a leaf spring 88, to a raised position (FIG. 19) projecting above pin-engaging surface 36 so as to displace a corresponding pin 44 to a position lying entirely outside keyway 66. Leaf spring 88 may be deflected so that pin-engaging seat 86 retracts to a depressed position (FIG. 20) lying substantially level with pin-engaging surface 36 to allow insertion and removal of key shaft 34 from keyway 66.

It should be noted that pin-biasing assembly 82 provides a cost effective and improved security alternative to the floating-pin described above in the context of the prior art. Specifically, the use of assembly 82 requires no modification of the lock cylinder structure other than setting of the corresponding pin to allow unlocking at the appropriate position, leaving the presence and position of the "short" pin 44*a* undisclosed alternatively, pin 98 in FIG. 27.

While pin-biasing assembly 82 is by no means limited to use with the rotatably pin arrangement of the present invention, the combined use of these features is particularly advantageous. Thus, pin-engaging seat 86 preferably features at least two depressions 40 separated by an intermediate ridge 42 configures to rotate a pin to a given rotational position in a manner similar to seats 38 described above.

FIGS. 21–26 show a second preferred form of pin-biasing assembly 82, which employs a helical spring 90 to replace leaf spring 88 in raising pin 44 to a position lying outside the keyway 66. In this form recess is replaced by a much more compact bore 85, and pin-engaging seat 86 is replaced by pin-engaging seat 91. Bore 85 is preferably undercut to form an edge 87, so that when pin-engaging seat 91 is inserted in bore 85, an edge 93 thereof becomes deformed within its flexible limit, enabling snap-in insertion of pin-engaging seat 91, thereby retaining it in bore 85.

Here too, pin-biasing assembly 82 is preferably combined with depressions 40 and ridge 42 for rotating the corresponding pin 44 to a predefined angular position. To ensure that pin-engaging seat 91 remains in the intended angular position (as denoted by angle β), bore 85 and pin-biasing assembly 82 are preferably provided with complementary slidingly-interlocking features, such as flat side facets 92 (FIGS. 25 and 26) configured to prevent rotation of pin-biasing assembly 82 relative to key shaft 34.

Figure 28:
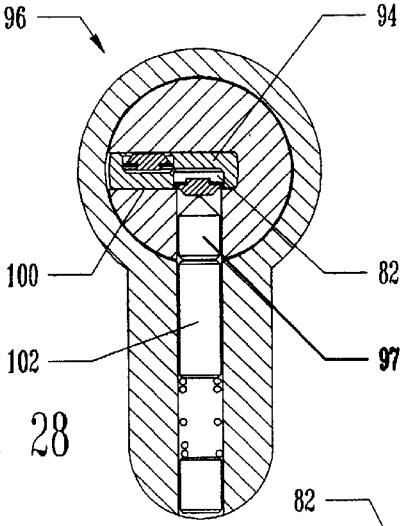
FIG. 28 is a cross-sectional view taken along the line XXVIII—XXVIII of FIG. 27.
Figure 27:
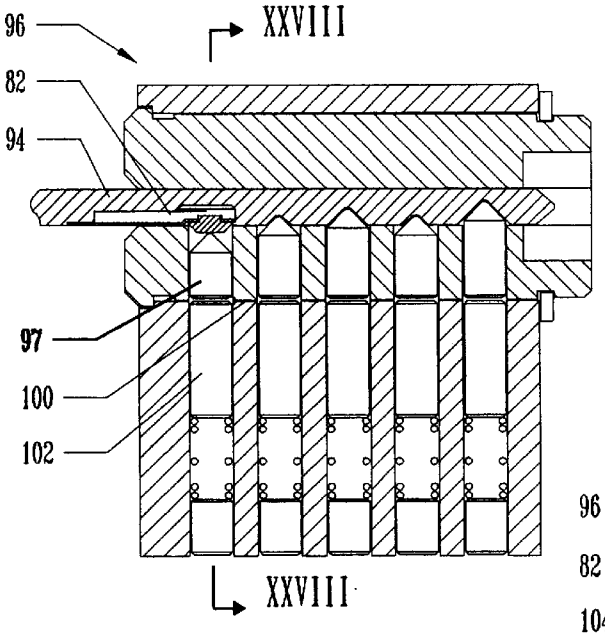
FIG. 27 is a cross-sectional view taken parallel to the axis of a lock cylinder illustrating a key with a pin-biasing assembly similar to that of FIGS. 15–20 used with an otherwise conventional cylinder lock.

Finally, referring briefly to FIGS. 27–30, it will be appreciated that pin-biasing assembly 82 may be used to advantage as an alternative to floating pin constructions in otherwise conventional flat-key cylinder locks. Thus, FIGS. 27 and 28 illustrate the use of key 94 with a pin-biasing assembly to unlock a cylinder lock 96 in which one pin 98 must be displaced to a position in which it lies entirely outside the keyway 100. It should be noted that, other than the length of pin 98, lock 96 is an unmodified conventional cylinder lock employing drive pins 102 and insensitive to angular pin position. Accordingly, key 94 is implemented as an otherwise conventional key with round pin-engaging depressions. In this case, pin-engaging seat 86 does not require any recessed features. In other respects, this implementation of pin-biasing assembly 82 is analogous to the leaf spring implementation of FIGS. 19 and 20.

Figure 30:
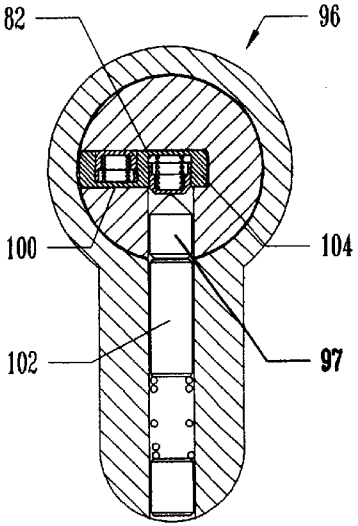
FIG. 30 is a cross-sectional view taken along the line XXX—XXX of FIG. 29.
Figure 29:
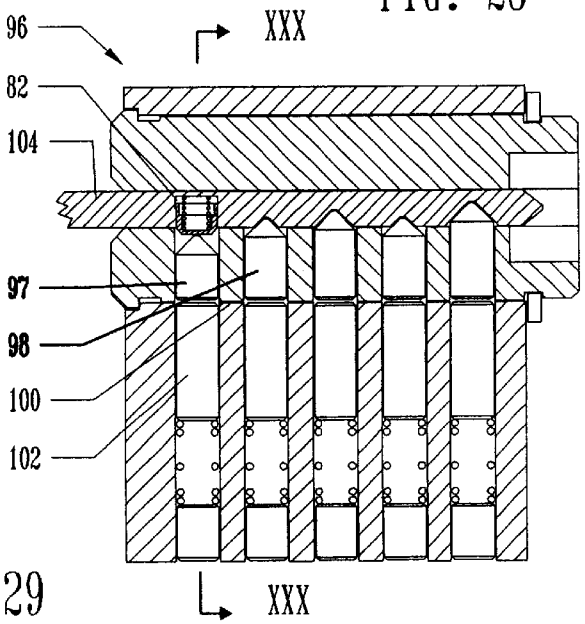
FIG. 29 is a cross-sectional view taken parallel to the axis of a lock cylinder illustrating a key with a pin-biasing assembly similar to that of FIGS. 21–24 used with an otherwise conventional cylinder lock.

FIGS. 29 and 30 illustrate the use of an alternative key 104, with a pin-biasing assembly analogous to the helical spring implementation of FIGS. 21–26, to unlock the cylinder lock 96. In this case, since the angular position of pin-engaging seat 86 is not significant, the recess and pin-biasing assembly may be formed with circular symmetry, thereby simplifying manufacture of the key.

It will be appreciated that the above descriptions are intended only to serve as examples, and that many other embodiments are possible within the spirit and the scope of the present invention.

What is claimed is:

1. A locking system comprising a cylinder lock of a type having rotatable pins which must be rotated to a given rotational position to effect unlocking thereof, and a key for use therewith, said cylinder lock comprising:

(a) a cylinder housing defining a bore;

(b) a plug deployed within said bore, said plug having a longitudinal axis and defining a keyway and at least one pin channel communicating with said keyway; and (c) at least one pin disposed in said at least one pin channel so as to be displaceable along, and rotatable about, a pin axis, said pin having an engagement end proximal to said keyway, wherein said engagement end is formed with at least two engagement features projecting parallel to, but displaced from, said pin axis, said at least two engagement features being separated by at least one depression, and wherein said pin is free to rotate through 360° about said pin axis, said engagement features being terminated in rounded end portions, said key comprising:

a key shaft configured for insertion into said cylinder lock along said keyway in a direction of insertion, said key shaft having at least one pin-engaging face which features a plurality of recessed seats, each of said plurality of recessed seats being configured to rotate said at least one pin to any given rotational position relative to said direction of insertion, wherein each of said plurality of recessed seats is formed with at least two similar conical depressions intersecting along a line so as to form an intermediate ridge, said intermediate ridge being capable of contact with said engagement features only at a contact point which subtends a relatively very small angle with respect to said pin axis, such that at said contact point, any resting position of said engagement features on said ridge is unstable, causing said engagement features to slide into proper engagement within said conical depressions.

2. The locking system of claim 1, wherein a first of said at least two engagement features of said cylinder lock pin is longer than a second of said at least two engagement features of said cylinder lock pin along an axis parallel to said pin axis.

3. The locking system of claim 1, wherein said plug of said cylinder lock further features at least one lateral channel communicating with said pin channel, wherein said lateral channel is generally perpendicular to said plug axis, and wherein said cylinder housing further features an engagement aperture alignable with said lateral channel, and wherein said pin features a pair of through-hole alignment apertures, the lock further comprising a side rod deployed within said at least one lateral channel and displaceable between a locking state engaged within said engagement aperture, thereby opposing both rotation and axial displacement of said plug relative to said cylinder housing, and a free state in which a part of said side rod is engaged within either of said alignment apertures, thereby allowing rotation of said plug relative to said cylinder housing.

4. The locking system of claim 1, wherein said key is configured for insertion into said keyway, said key having a seat located to come into alignment with said pin, said seat being formed with at least two depressions separated by an intermediate ridge and configured such that said pin is rotated by contact with said seat to an angularly aligned position in which said engagement features are aligned with said depressions.

5. The locking system of claim 4, wherein said seat and said engagement features of said lock are configured such that contact between said pin and said seat is effective to rotate said pin to said angularly aligned position from an arbitrary initial relative angular position anywhere within a range of at least about 160°.

6. The locking system of claim 4, wherein said seat and said engagement features of said lock are configured such that the contact between said pin and said seat is effective to rotate said pin to said angularly aligned position from an arbitrary initial relative angular position anywhere within a range of at least about 170°.

7. The locking system of claim 4, wherein said key features a pin-engaging face, said seat being spring-biased to a raised position projecting above said pin-engaging face so as to displace said pin to a position in which said engagement end lies outside said keyway.

8. The locking system of claim 1, wherein said intermediate ridge of a first of said recessed seats of said key extends in a first direction, said intermediate ridge of a second of said recessed seats extending in a second direction non-parallel to said first direction.

9. The locking system of claim 1, wherein said depressions of a first of said recessed seats of said key have a first maximum depth, said depressions of a second of said recessed seats having a second maximum depth greater than said first maximum depth.

10. The locking system of claim 1 in which said cylinder lock is of a type having at least one pin which must be displaced to a position in which it lies entirely outside said keyway, and wherein said key shaft further comprises:

a) at least one pin-engaging face which features a recess; and b) at least one pin-biasing assembly mounted within said recess and providing a pin-engaging seat featuring at least two depressions separated by an intermediate ridge and configured to rotate a pin to any given rotational position while the pin is completely outside the keyway, said pin-engaging seat being spring-biased to a raised position projecting above said pin-engaging face and being retractable to a depressed position lying substantially level with said pin-engaging face.

11. The locking system of claim 10, wherein said pin-biasing assembly includes a leaf spring.

12. The locking system of claim 10, wherein said pin-biasing assembly includes a helical spring.

13. The locking system of claim 10, wherein said pin-biasing assembly includes a helical spring, said recess and said pin-biasing assembly being provided with complementary slidingly-interlocking features configured to prevent rotation of said pin-biasing assembly relative to said key shaft.

14. The locking system of claim 1 comprising said key for use with said cylinder lock of a type having at least one pin which must be displaced to a position in which it lies entirely outside said keyway.

15. A key for use in a cylinder lock of a type having rotatable pins which must be rotated to a given rotational position to effect unlocking thereof, wherein said cylinder lock comprises:

(a) a cylinder housing defining a bore;

(b) a plug deployed within said bore, said plug having a longitudinal axis and defining a keyway and at least one pin channel communicating with said keyway; and (c) at least one pin disposed in said at least one pin channel so as to be displaceable along, and rotatable about, a pin axis, said pin having an engagement end proximal to said keyway, wherein said engagement end is formed with at least two engagement features projecting parallel to, but displaced from, said pin axis, said at least two engagement features being separated by at least one depression, and wherein said pin is free to rotate through 360° about said pin axis, said engagement features being terminated in rounded end portions, said key comprising:

a key shaft configured for insertion into said cylinder lock along said keyway in a direction of insertion, said key shaft having at least one pin-engaging face which features a plurality of recessed seats, each of said plurality of recessed seats being configures to rotate said at least one pin to any given rotational position relative to said direction of insertion, wherein each of said plurality of recessed seats is formed with at least two similar conical depressions intersecting along a line so as to form an intermediate ridge, said intermediate ridge being capable of contact with said engagement features only at a contact point which subtends a relatively very small angle with respect to said pin axis, such that at said contact point, any resting position of said engagement features on said ridge is unstable, causing said engagement features to slide into proper engagement within said conical depressions.

16. The key of claim 15 in which said cylinder lock is of a type having at least one pin which must be displaced to a position in which it lies entirely outside said keyway, and wherein said key shaft further comprises:

a) at least one pin-engaging face which features a recess; and b) at least one pin-biasing assembly mounted within said recess and providing a pin-engaging seat featuring at least two depressions separated by an intermediate ridge and configured to rotate a pin to any given rotational position while the pin is completely outside the keyway, said pin-engaging seat being spring-biased to a raised position projecting above said pin-engaging face and being retractable to a depressed position lying substantially level with said pin-engaging face.

* * * * *